United States Patent [19]

Forbes, Jr. et al.

[11] 3,951,333

[45] Apr. 20, 1976

[54] SURGICAL PACKAGE

[75] Inventors: Hampton E. Forbes, Jr., Wilmington, Del.; William V. Plant, Westfield, N.J.

[73] Assignee: Westvaco Corporation, New York, N.Y.

[22] Filed: Apr. 1, 1975

[21] Appl. No.: 564,034

[52] U.S. Cl. ..... 229/51 TS; 206/438; 206/498

[51] Int. Cl.[2] ..... B65D 5/54

[58] Field of Search ..... 206/438, 439, 498; 229/51 C, 51 TS, 51 AS, 51 WB

[56] References Cited

UNITED STATES PATENTS

| | | | |
|---|---|---|---|
| 3,495,702 | 2/1970 | Kuster | 206/439 |
| 3,498,448 | 3/1970 | Kuster | 229/51 TS |
| 3,687,358 | 8/1972 | Wink et al. | 206/498 |
| 3,727,750 | 4/1973 | Petter | 206/438 |
| 3,810,813 | 5/1974 | Ellis | 206/498 |
| 3,826,421 | 7/1974 | Morse et al. | 229/51 AS |
| 3,853,261 | 12/1974 | Moore | 229/51 AS |

FOREIGN PATENTS OR APPLICATIONS

| | | | |
|---|---|---|---|
| 421,806 | 4/1967 | Switzerland | 229/51 AS |
| 1,482,616 | 4/1967 | France | 229/51 AS |
| 649,764 | 12/1962 | Italy | 229/51 AS |
| 672,175 | 10/1963 | Canada | 229/51 TS |

*Primary Examiner*—William Price
*Assistant Examiner*—Bruce H. Bernstein

[57] ABSTRACT

The surgical package of the present invention is formed from a single blank of paperboard or the like that is preferably coated with a heat sealable barrier coating on both sides thereof, but may be coated on only one side or not at all. The package also has a removable tear strip for providing access to the contents thereof, and further includes, (1) a means at the starting end of the tear strip to aid the initial tearing and delamination of the tear strip from the paperboard material and (2) a skirt element underlying the tear strip area and adhered to the inside of the blank only on each side of the tear strip area for the purpose of maintaining the sterility of the contents of the package even after the tear strip is removed. The skirt element further includes a weakened area, produced by perforations or the like, in the region which lies directly under the access opening provided by removing the tear strip, to permit the separation of the skirt element along its weakened area and the ready removal of the contents of the package. The portions of the skirt remaining in the tear strip area provide sterile surfaces adjacent the access opening to prevent the contamination of the contents as they are removed from the package.

7 Claims, 11 Drawing Figures

SURGICAL PACKAGE

BACKGROUND OF INVENTION

Articles and instruments for use in surgical and other medical procedures must be enclosed in a bacteria-inpervious and sterilized environment so that they will remain free of bacteria until they are needed. Surgical packages are therefore conventionally made of materials that are generally impervious to bacteria. These packages must also be designed so that they may be readily and rapidly opened without affecting the sterility of the contents and so that the contents may be removed from the package according to approved sterile techniques. It is conventional in such packages to provide tear strip openings for permitting access to the contents. The tear strips have generally been formed by scoring the exterior and interior surfaces of the paperboard to define planes of cleaveage therein along which the tear strips delaminate. In the past, at least two problems have been encountered with such package openings. First, where the packages are formed with glued manufacturers joints, the starting end of the tear strip which is pulled upon to open the packages is generally adhesively bonded to the paperboard in the region of the manufacturers joint, and these tear strip arrangements frequently malfunction by either not delaminating at all or by delaminating along planes other than those defined by the tear strip scores at the interior and exterior surfaces of the paperboard. The improper delamination of the tear strips is caused by the fact that the adhesive bond between the manufacturers joint and the starting end of the tear strip, and the package, is stronger than the bond between the plies of delaminatable paperboard material from which the package is made. In those packages which are formed from blanks having heat sealable barrier coatings, a similar problem occurs because the barrier films are very tough and very difficult to tear, thus making it even more difficult to initiate the opening of the tear strip feature. A second problem that occurs with the packages of the prior art having conventional tear strip openings, is that once the tear strip is removed from the tear strip area, the contents of the package are immediately exposed to bacteria through the tear strip opening. Similarly, in the packages of the prior art, the paperboard surfaces which remain adjacent the access opening when the tear strip is removed provide a hostile environment for the contents of the package as they are removed from the package.

Several prior U.S. patents have attempted to overcome the problems noted above as described hereinafter. In U.S. Pat. No. 3,727,750, to Petter, a sterile package is disclosed having a removable tear strip which includes an intricate folded over tab formed on one end of the tear strip and a carefully defined plane of cleaveage along which the tear strip may be initially delaminated to insure a positive opening. However, once the tear strip of the Petter patent is removed, the contents of the sterile package are immediately exposed to bacteria and the design of the tear strip is such that only a minimal amount of protection is provided adjacent the edges of the access opening to protect the contents from being further contaminated as they are withdrawn from the package.

In a second U.S. Pat. No. 3,853,261, to Moore, another sterile package is disclosed that is formed from a blank of paperboard coated on at least one surface with a heat sealable barrier film such as polyethylene or the like. In this latter patent limited depth cuts are formed in the exterior surface of the carton blank in the area under the tear strip in the region of the manufacturers flap to permit delamination of the paperboard material when the tear strip is initially torn. However, as in the case of the Petter invention, the Moore patent also exposes the contents of the package to bacteria as soon as the tear strip is removed. Moreover, because the Moore package is comprised of a blank having a heat sealable barrier film the carton is sealed closed at the manufacturers flap by a heat sealing process and this process tends to adhere the tear strip to the manufacturers flap with considerable tenacity. Therefore the limited depth cuts in the exterior surface of the carton blank in the area under the tear strip of the Moore carton are not always sufficient to insure a proper opening every time.

In a third U.S. Pat. No. 3,495,702, to Kuster, a surgical package is disclosed which also incorporates a removable tear strip. Further, in one of the embodiments of the Kuster invention a sheet of relatively thin and flexible material underlies a paperboard panel in the area of the tear strip. The sheet of material is sealed to both the tear strip itself and the paperboard panel on each side of the tear strip. Thus, when the tear strip of Kuster is removed, the sheet of material underlying the paperboard panel is also torn, since it is sealed to the tear strip, and the simultaneous removal of the tear strip and that portion of the underlying sheet material that is adhered thereto creates a gap which exposes the contents of the carton to bacteria simultaneously with the removal of the tear strip.

On the other hand, the Kuster package is designed to hopefully leave two outward faces of the sheet of relatively thin and flexible material adjacent the access opening as the tear strip is removed to prevent further contamination of the contents of the carton as they are removed from the package.

SUMMARY OF INVENTION

An object of the present invention is to overcome the above described problems involved with the tear strip openings for surgical packages that are formed from single blanks of paperboard or the like, and particularly those blanks that have barrier coatings on at least one surface thereof.

Another object of the present invention resides in the provision for such packages of means whereby the tearing and delamination of the tear strip may be easily and reliably started.

Another object of the present invention is to provide an improved tear strip opening for a surgical package whereby the sterility of the contents remains substantially intact even after the tear strip is removed.

Finally it is yet another object of the present invention to provide an improved surgical package which includes sterile surfaces adjacent the access opening after the tear strip is removed and the contents are exposed, to prevent contamination of the contents as they are removed from the package.

In accomplishing these and other objects there is provided in accordance with the present invention a surgical package made at least in part of a delaminatable material such as paperboard that is preferably coated with a heat sealing barrier coating on both surfaces thereof. The surgical package is made from a folded blank and contains a removable tear strip formed in the delaminatable material by scoring both the exterior and interior surfaces of the blank so as to define planes of cleaveage along which the tear strip may be delaminated to open the package. In addition, the present invention includes a means for insuring the initial delamination of the tear strip, particularly in the region of the manufacturers joint, that in the illustrated embodiment takes the form of an abbreviated length of reinforcing tape which is adhered to the surface of the paperboard at the starting end of the tear strip to strengthen the tear strip and aid the initial tearing and delamination of the tear strip. Further, the present invention includes a skirt element formed from glassine paper, paper foil or a synthetic film material underlying the tear strip area which is adhered only to the inside of the package on each side of the tear strip. The skirt thus provides a substantially intact sterile environment to the inside of the package even after the tear strip is removed. For the purpose of separating the skirt element and obtaining access to the contents of the package after removal of the tear strip, the skirt element is provided with a weakened area produced by perforating, partially cutting creasing, embossing, debossing or the like, the skirt material in the region which lies directly under the access opening provided by removing the tear strip.

DESCRIPTION OF DRAWING

Other objects of this invention will become apparent from the following detailed description and the accompanying drawings which are described below.

DETAILED DESCRIPTION

Figure 1:
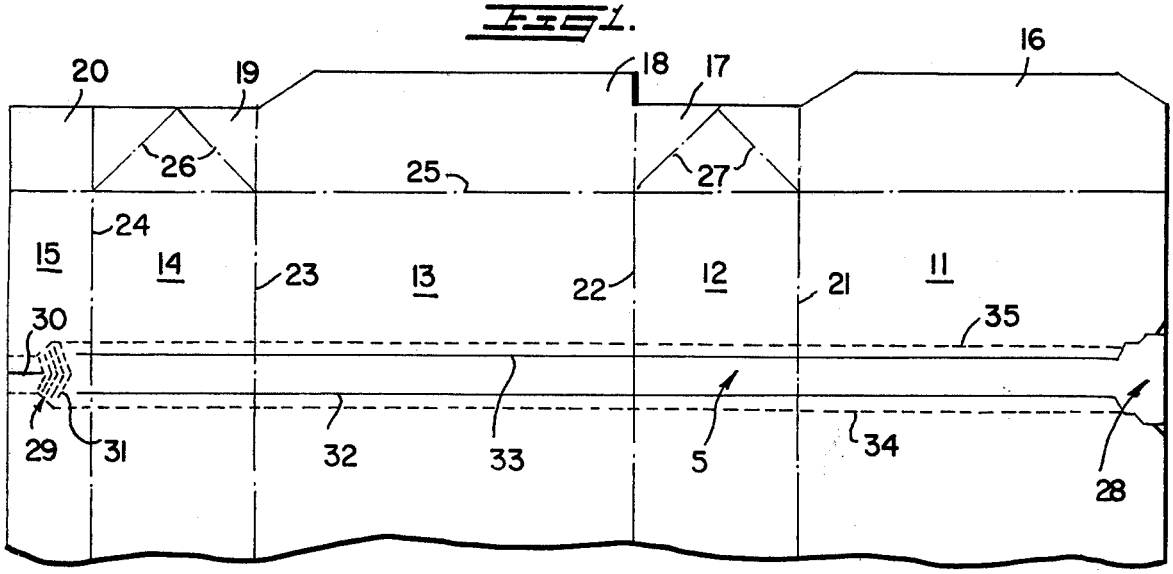
FIG. 1 is a fragmentary plan view of a blank showing the details of the tear strip opening for a typical surgical package.
Figure 2:
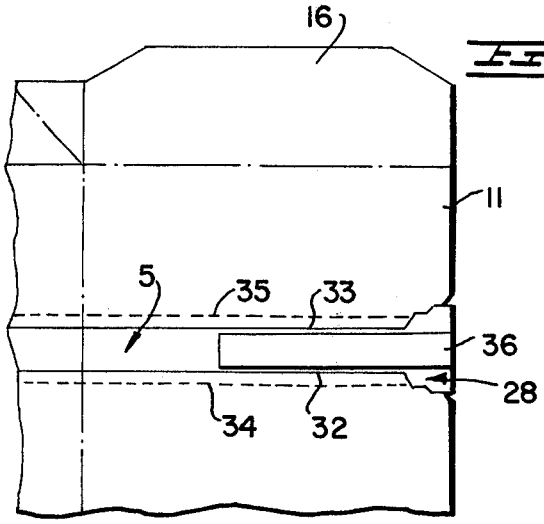
FIG. 2 is a fragmentary plan view of the blank of FIG. 1 illustrating one of the features of the present invention.

FIG. 1 illustrates a typical blank configuration and tear strip arrangement for a surgical package substantially as disclosed herein. The blank comprises a first front panel 11, a side panel 12, a back panel 13, and a second side panel 14, hingedly connected together along score lines 21, 22 and 23. A manufacturers glue flap 15 is hingedly connected to the second side panel 14 along a score line 24. At the top of the blank of FIG. 1, a plurality of top closure flaps 16,17,18,19 and 20 are hingedly connected to the respective carton panels along a score line 25, and are adapted to form a top closure for the carton. A similar bottom closure may be formed for the carton of the present invention, however, the particular forms of the top and bottom closure for the package are not pertinent to the present invention and are not further described. The main body of the blank of FIG. 1 is cut and scored to form a tear strip 5 which extends across each of the front, side and back panels of the package. The tear strip is generally formed by two pairs of spaced apart and parallel cut lines of limited depth on the inner and outer surfaces of the paperboard material. Cut lines 32 and 33 are shown in FIG. 1 on the inside of the blank and do not extend completely through the blank material. Meanwhile, similar cut lines 34 and 35 are shown on the outer surface of the blank and also do not extend completely through the blank material. When the tear strip is operated to open the package, the paperboard fibers separate or delaminate between the cut lines 33–35 and 32–34 so that the barrier properties of the paperboard are not penetrated until the tear strip is removed. At one end of the tear strip 5 is front panel 11, the tear strip includes an enlarged starting portion 28 which is used to initiate the tearing of the tear strip itself. At the other side of the blank of FIG. 1 the tear strip 5 is provided with a plurality of limited depth cut lines at 30 and 31, which form a delaminatable portion 29 in the manufacturers flap 15. Accordingly, a careful review of FIG. 1 shows that the illustrated blank is substantially of conventional form and does not illustrate any of the primary features of the present invention. FIG. 2 illustrates a portion of a blank substantially as shown in FIG. 1, but with the addition of one of the features of the present invention particularly for insuring delamination of the area 29 in the manufacturers flap 15 when the primary tear strip portion 28 is removed. For this particular purpose, an abbreviated length of reinforcing tape 36 is shown as being applied to the starting end of the tear strip 5 on the inside surface of the blank. The reinforcing tape is preferably made from a polyolefin such as polyethylene or the like, but could take other forms depending upon the type of coating applied to the blank and the method used to adhere the manufacturers flap 15 to the front panel 11.

The package of the present invention is generally coated with polyethylene on both sides thereof, and the manufacturers flap 15 is generally heat sealed to the inside surface of the front panel 11. Thus the presence of polyethylene reinforcing tape on the tear strip 5 insures a good bond between the starting portion 28 of tear strip 5 and the delaminatable section 29 of the manufacturers joint. Accordingly, when the portion 28 of the tear strip 5 is initially pulled either by the users finger or some instrument, the tape 36 provides positive assurance that the tear strip portion 28 will cause the dalaminatable portion 29 of manufacturers flap 15 to delaminate. In the alternative, and particularly where delamination of the manufacturers flap is not desired or required, the same easy opening effect can be achieved by employing an abhesive-type adhesive between the portion 28 of the tear strip 5 and the portion 29 of the manufacturers flap 15. With only an abhesive adhering the portions 28 and 29 together, the initial starting of the tear strip and the subsequent delamination of the paperboard material between limited depth cuts 33–35 and 32–34 would be assured.

Figure 3A:
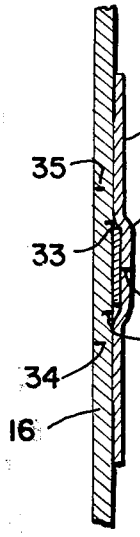
FIG. 3A is a sectional view through the lines A—A of FIG. 3.
Figure 3:
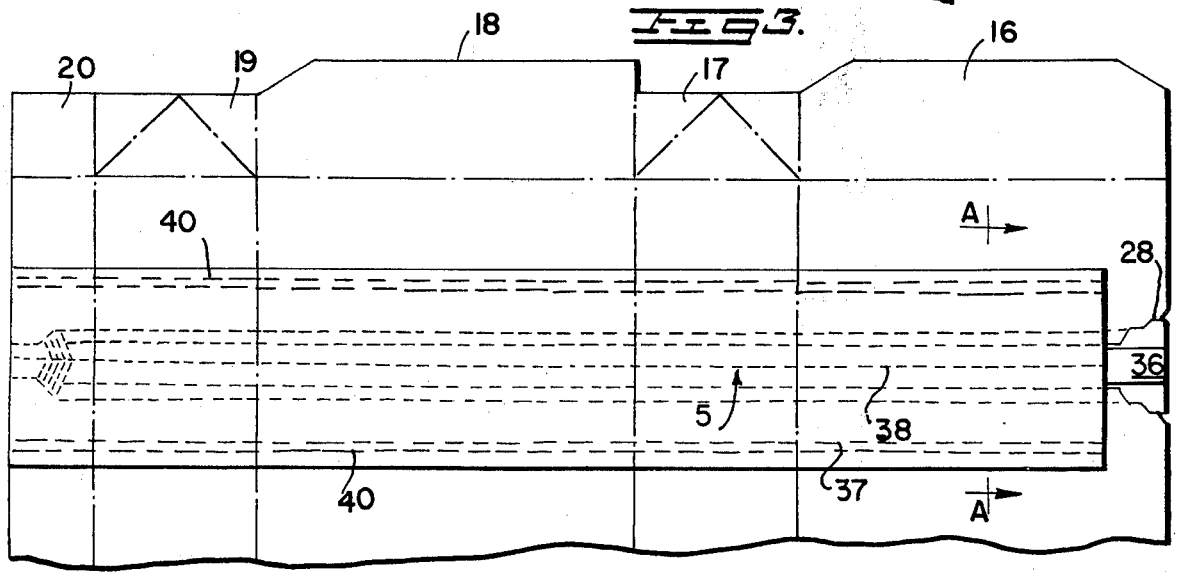
FIG. 3 is a fragmentary plan view of the blank of FIG. 1 illustrating a second feature of the present invention.
Figure 5:
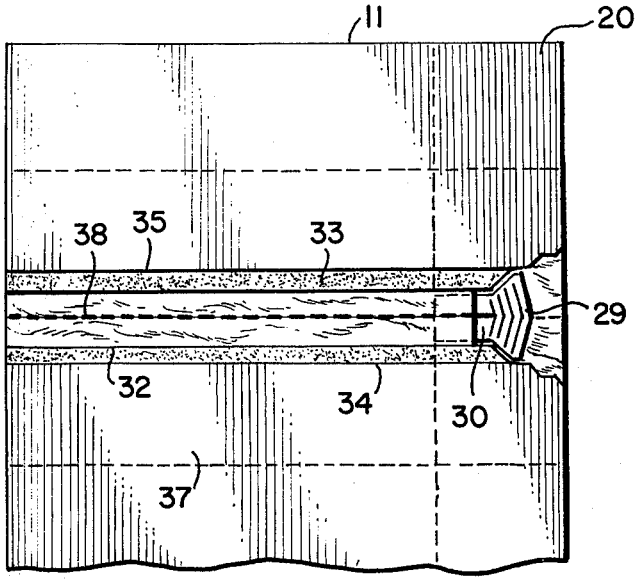
FIG. 5 is a fragmentary front view of the surgical package of FIG. 4 with the tear strip removed.

FIG. 3 illustrates the second important feature of the present invention which includes the skirt element 37 that is adhered to the inside of the blank so as to underlie only the tear strip area and provide a substantially sterile environment for the contents of the carton even after the tear strip is removed therefrom. Note in FIG. 3 that the skirt element 37 extends across all four panels of the blank, and is adhered to the inside of the blank only in the areas defined by the numerals 40 at each side of the tear strip itself. Meanwhile, a line of weakness identified by numeral 38 is applied to the skirt 37 and is arranged to lie substantially directly underneath and bisect the center line of the tear strip opening 5. The weakened area 38 in skirt element 37 is preferably substantially impervious to the penetration of bacteria into the carton once the tear strip 5 is removed and is provided in the skirt element 37 by perforating, partially cutting, creasing, embossing or debossing the skirt material. The skirt material can be formed from any desired material such as glassine paper, paper, foil or synthetic film, but is preferably paper that can readily be made bacteria impervious by any of the well known techniques used for such purpose. However, with the tear strip 5 removed from the package as shown in FIG. 5, the package is still not fully opened since the presence of the skirt element 37 lends sufficient integrity to the package to keep the top portion in place. Therefore, the weakened area 38 in skirt element 37 is necessary so that after the tear strip 5 is removed from the package, the top portion of the package can be separated from the bottom portion thereof with a simple twist and thrust by the hands of the person opening the package.

Figure 4:
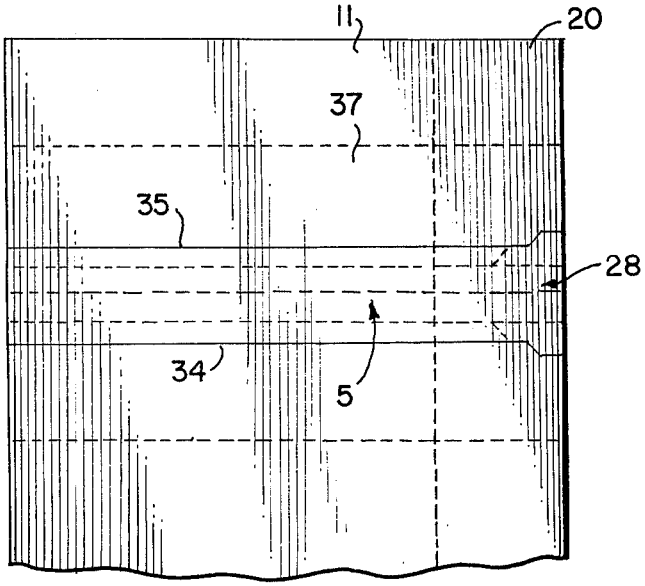
FIG. 4 is a fragmentary front view of the closed surgical package prepared from the blank of FIG. 3.

FIG. 4 illustrates the package of the present invention after it is formed and sealed. Generally such packages are sterilized after they are sealed by exposing the package and contents to a sterilizing treatment. FIG. 5 illustrates the package of FIG. 4 with the tear strip removed. It will be noted in FIG. 5 that the starting portion of tear strip 5 has completely delaminated the area 29 of manufacturers flap 15 in such a manner that a portion thereof still remains in place. Meanwhile, the delaminatable planes of cleaveage formed between the limited depth cut lines 33–35 and 32 –34 are plainly shown. However, it will be noted that because of the presence of the skirt element 37 adhered to the inside of the package at each side of the tear strip area, the package remains more or less stable even with the removal of the tear strip. In addition, it may be seen in FIG. 5 that the weakened area 38 in the skirt element 37 lies substantially along the center of the access area provided by the removal of tear strip 5. Thus, in actual use the tear strip can be removed from the package without disturbing the integrity of the package, and because of the presence of the skirt element 37 on the inside of the package, the contents remain substantially in their original sterile state except for the possiblity of the penetration of some bacteria through the weakened area 38 in skirt 37.

Figure 6:
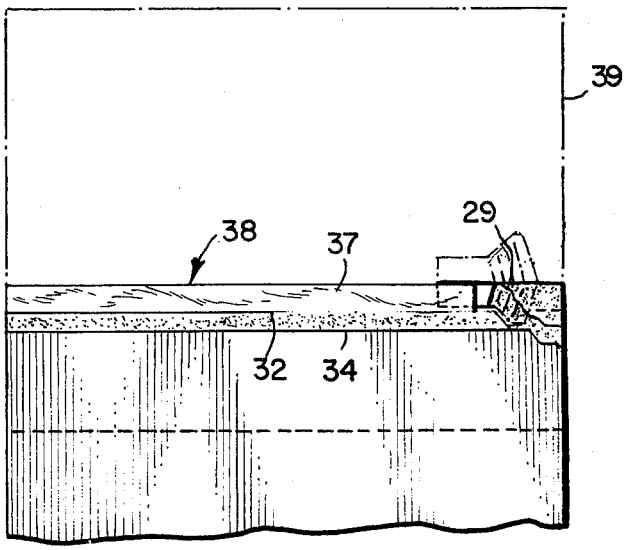
FIG. 6 is a view similar to FIG. 5 showing the surgical package with the top portion removed.

When access to the contents 39 of the package is finally desired, it is only necessary to twist the top portion of the package to the side and the skirt 37 separates along its weakened area 38 to present a package substantially as shown in FIG. 6. Thus, as shown in FIG. 6, for removal of the contents 39 from the package, the presence of portions of skirt element 37 that extend above the delaminated area of the paperboard package between the cut lines 32 and 34, provide sterile surfaces adjacent the access opening of the carton to prevent contamination of the contents 39 as they are removed from the package.

Figure 7:
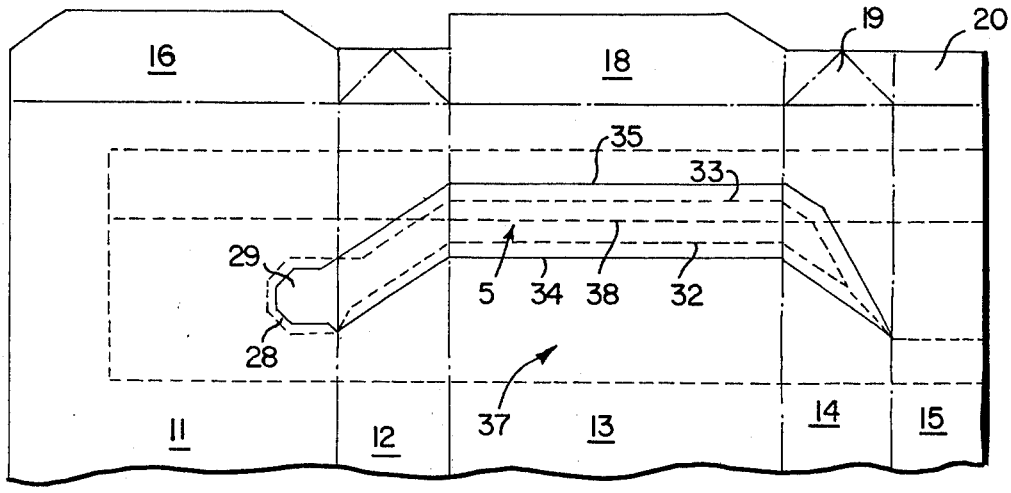
FIG. 7 is a fragmentary plan view of a blank showing a modified version of the tear strip opening illustrated in FIG. 3.
Figure 8:
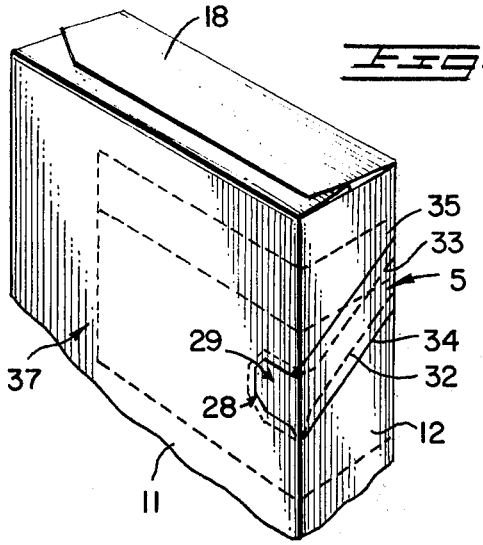
FIG. 8 is a partial perspective view of the rear of the package formed from the blank of FIG. 7.

FIG. 7 illustrates a modified form of the blank and the package shown in FIGS. 2–6. In FIG. 7, the tear strip area extends over the front panel 13 of the carton and two adjacent side panels 12 and 14 with the tear strip opening tab 28 formed in the back panel 11. Thus the carton formed by the blank of FIG. 7 does not have a completely removable top, but has a top that may be folded back to expose the contents once the tear strip 5 is removed. In addition, the embodiment of FIG. 7 also differs from the embodiment of the package shown in FIGS. 2–6 because the primary tear strip portion 28 is located in a position on the package that is offset from the weakened area 38 in skirt element 37. When the primary tear strip portion 28 of FIG. 7 is depressed to initiate the removal of the tear strip, there is little or no danger of accidently rupturing the weakened area 38 in skirt 37. This feature can be readily observed by referring to the drawings, particularly FIGS. 8 and 9. Furthermore, the details of construction of the tear strip 5 in FIG. 7 are also slightly different from those employed in FIGS. 2–6.

For instance, the delaminatable portion 29 in FIG. 7, formed on the inside of the blank by the cut lines 32, 33, is preferably made slightly larger than the primary tear strip portion 28. With this construction, when the portion 28 is depressed to initiate the tear, the entire area designated 29 on the inside of the blank separates from the blank and continues with the tear strip 5 as it is removed. In the case of the package shown in FIGS. 7–10, when the tear strip 5 is removed, the cut lines 34, 35 on the outside of the blank cooperate with the cut lines 32, 33 on the inside surface of the blank to form the normal delaminated areas found on the package shown in FIGS. 2–6. The reinforcing tape 36 used on the package of FIGS. 2–6 is not shown in FIG. 7, however it could also be applied to the tear strip of the package shown in FIGS. 7–10, if necessary, to insure complete delamination of the area 29 on the inside of the blank.

Figure 9:
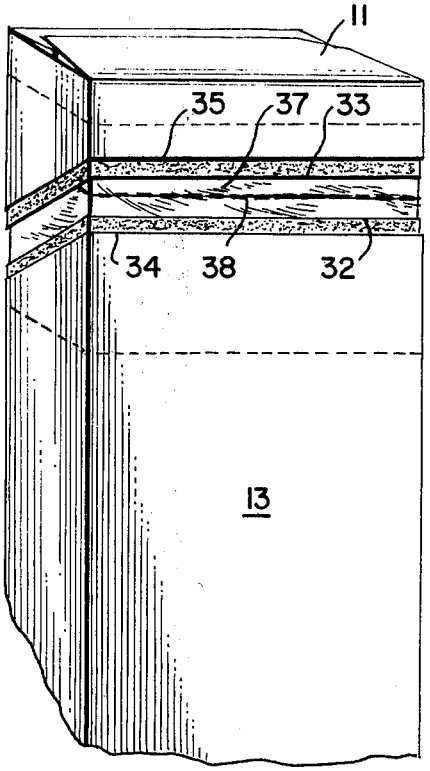
FIG. 9 is a fragmentary front view in perspective of the surgical package formed from the blank of FIG. 7 with the tear strip removed; and, FIG. 10 is a partial perspective view of the package of FIGS. 8 and 9 with the top of the package folded back to permit access to its contents.

The remaining features of the package of FIGS. 7–10 are similar to those shown in FIGS. 2–6 particularly with regard to the presence of the skirt element 37. In this respect, as before, the skirt element 37 extends around the inside of the package over at least three panels thereof and only in the region of the tear strip opening. Moreover, the skirt element 37 is adhered to the inside of the blank only in the region located on each side of the tear strip. That is, for the blank shown in FIG. 7, the skirt 37 would be adhered to the blank both above and below the tear strip 5 but not in the region of the tear strip. When the tear strip 5 is removed from the package as shown in FIG. 9, the skirt 37 becomes exposed, yet the weakened area 38 therein is only exposed along the panel of the package identified as 13. In addition, because the tear strip 5 in FIGS. 7–10 does not extend completely around the package, the integrity of the package shown in FIG. 9 with the tear strip removed remains quite good. Moreover, with the skirt in position, covering the access area exposed by removal of the tear strip 5, the contents of the package remain substantially sterile until the weakened area at 38 is broken.

Figure 10:
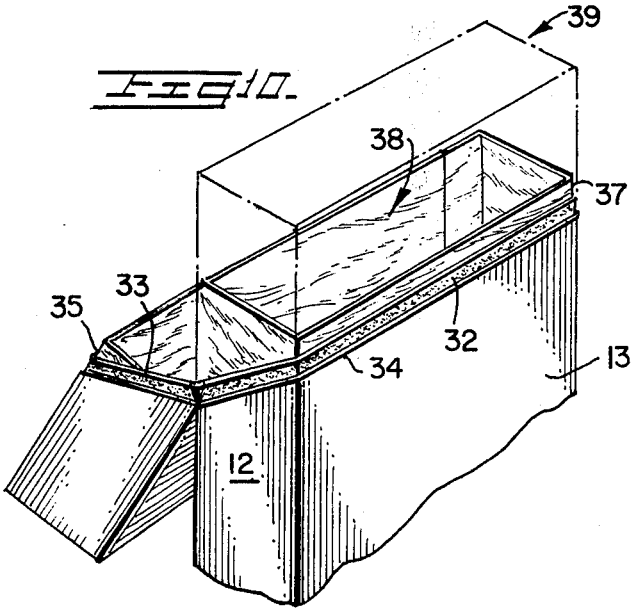

FIG. 10 illustrates the condition of the package formed from the blank in FIG. 7 after the skirt element 37 is spearated along its weakened area 38 to expose the contents 39. Note that a portion of the skirt 37 extends above the front wall 13 of the package so that as the contents are removed, they cannot come in contact with the exterior surfaces of the package and become contaminated.

The paperboard or like material used in the manufacture of the package of the present invention is of the type conventionally used in making surgical packages as is the skirt material 37. Further, although only two specific embodiments have been disclosed for the present invention, they have been selected to show and describe in detail the inventive concept covered by the present invention. Thus it may be understood that the invention herein is only limited by the scope of the appended claims.

We claim:

1. A surgical package for packaging sterile products consisting of an outer protective carton formed from a blank of delaminatable material and including a removable tear strip for providing access to the contents of said carton, said tear strip being defined in said delaminatable material by limited depth exterior and interior cut lines to define planes of cleaveage along which said tear strip delaminates to separate from said carton, the improvement comprising:

a. means including the addition of a skirt element on the inside of said carton in the region of said tear strip said skirt element being adapted to cover the otherwise exposed contents of said carton when said tear strip is removed for maintaining the contents of said carton substantially sterile after the tear strip is removed.

2. The package of claim 1 wherein the carton consists of at least four panels and the tear strip extends across at least three of said panels.

3. The package of claim 2 wherein the skirt element is adhered to the inside of said carton blank only in the region outboard of said tear strip.

4. The package of claim 3 wherein said skirt element further includes a weakened area which is arranged to lie directly under said tear strip and substantially bisect the access opening provided in said carton by the removal of said tear strip.

5. The package of claim 4 wherein a reinforcing means is provided on the inside of said carton blank at the starting point of said tear strip to initiate the delamination of said tear strip from the carton delaminatable material.

6. The package of claim 5 wherein the reinforcing means is in the form of an abbreviated length of tape made from a polyolefin material and applied to the tear strip on the inside of said carton blank.

7. The package of claim 6 wherein the polyolefin tape material is polyethylene.

* * * * *